United States Patent [19]

Lorenz et al.

[11] 4,383,547

[45] May 17, 1983

[54] PURGING APPARATUS

[75] Inventors: Andrew K. Lorenz, San Jose; Scott R. Mobley, Los Gatos, both of Calif.

[73] Assignee: Valin Corporation, Sunnyvale, Calif.

[21] Appl. No.: 248,519

[22] Filed: Mar. 27, 1981

[51] Int. Cl.[3] ..... B08B 9/02

[52] U.S. Cl. ..... 137/240; 134/166 C; 222/148

[58] Field of Search ..... 137/238, 240; 134/166 C, 167 C, 168 C, 169 C; 222/148

[56] References Cited

U.S. PATENT DOCUMENTS

| | | | |
|---|---|---|---|
| 872,494 | 12/1907 | Blackburn | 134/167 C |
| 1,981,611 | 11/1934 | Cappa | 137/240 |
| 4,120,331 | 10/1978 | Krivanek | 137/240 |
| 4,169,486 | 10/1979 | Otleman et al. | 137/240 |

*Primary Examiner*—George L. Walton
*Attorney, Agent, or Firm*—Thomas E. Schatzel

[57] ABSTRACT

A purging apparatus having a process gas connector wherein a purging gas is injected into the connector so that trapped process gas is thoroughly purged from the connector. Tubing in the shape of a double helix is connected to the process gas connector. One tube of the double helix is connected to a purge valve for providing purging gas to an injection port of the process gas connector. The other tube of the double helix provides a flow path for the process gas which then flows through a filter, a vacuum pump valve, a high pressure process valve, a regulator, a low pressure process valve, and then out to the process equipment. In order to purge the process gas from the purging apparatus, the high pressure process valve is set to direct a gas flow to a vent valve which is connected to a scrubber. The low pressure process valve may also be set to direct gas flow to a low pressure vent valve which is also connected to a scrubber. Finally, the purging apparatus may be evacuated by setting the vacuum pump valve to permit gas to be evacuated from the purging apparatus.

9 Claims, 3 Drawing Figures

PURGING APPARATUS

BACKGROUND OF THE INVENTION

1. Field of the Invention

The invention relates generally to purging systems and more particularly to a purging apparatus for safe connection of harmful gas sources to process equipment.

2. Description of the Prior Art

There are numerous industrial applications which require the use of dangerous gases. Certain gases are deadly poisonous if inhaled, others are highly explosive and yet others will burn with invisible flames when they come in contact with air. Frequently, the gases are stored in steel cylinders weighing approximately 150 to 175 lbs and are stored at pressures as high as 4000 psi.

When a cylinder containing gas that is toxic, corrosive or that reacts with air is connected to process equipment all air must be flushed out or "purged" from the connecting tubing leading from the cylinder to the equipment. Also, when an empty cylinder is to be replaced, the dangerous gas must be purged from the tubing, regulator, valves, and related piping before the cylinder is disconnected. Thus, in the prior art, systems have been developed for purging the dangerous gases.

One such system is a cross-purge design which relies totally on diffusive mixing to remove the dangerous gas. The purging gas is introduced into the lines connected to the gas cylinder, allowed to mix for a short period of time, then released through a vent. This process is repeated until most of the dangerous gas is removed. However, this system has "dead-ends" where the dangerous gas may become trapped and thus not purged during the purging process.

Another purging system is disclosed in U.S. Pat. No. 4,169,486 issued to Otteman et al. Otteman discloses a small purge conduit inserted in the supply conduit so that its end terminates in close proximity to the connector to the gas cylinder. A purging is then passed through a purging conduit which then forces the dangerous gas out of the tubing near the connector to the gas cylinder. The cross-purge system has the disadvantage in that heavy gases can easily become trapped in dead-end spaces, especially near the connector to the gas cylinder. Otteman provided a means for forcing the process gas out of the space joining the connector to the gas cylinder.

SUMMARY OF THE PRESENT INVENTION

It is therefore an object of the present invention to provide a safe means for purging dangerous gases from tubing connected to a gas cylinder.

It is a further object to provide an improved means for purging gases from tubing connected to a gas cylinder which gases are highly toxic, corrosive or have a tendency to explode when mixed with air.

It is a further object to provide a purging apparatus which may be hard-mounted in a fixed position so that the piping will not be twisted or disturbed nor mechanical fittings loosened during cylinder connection or disconnection.

It is a further object to provide a purging apparatus having a flexible means for connection to a gas cylinder, allowing ease of alignment between the cylinder and the connection.

Briefly, a preferred embodiment of the present invention includes a connector for connecting a double-helix of tubing to a gas cylinder containing process gas. One tube of the double-helix is connected to an injection port of the connector and also to a valve for controlling the flow of a purging gas. The other tube of the double-helix is connected to a process gas port of the connector and also to a high pressure process valve. The high pressure process valve is connected to a high pressure vent valve and to a pressure regulator. On the opposite side of the regulator from the high pressure process valve is a low pressure process valve which permits flow of the process gas to the process equipment and flow of the purging gas through a low-pressure vent valve to a vent or scrubber.

An advantage of the purging apparatus of the present invention is that dangerous gases may be safely purged from tubing connected to the process gas cylinder.

Another advantage is that an improved means is provided for purging air from tubing connected to the process gas cylinder so that the process gas will not mix with air.

A further advantage is that the purging apparatus may be hard-mounted in a fixed position.

Another advantage is that flexible means is provided for connecting to the process gas cylinder so that stress on the connection and surrounding piping and fittings is reduced.

These and other objects and advantages of the present invention will no doubt become apparent to those of ordinary skill in the art after having read the following detailed description of the preferred embodiment which is illustrated in the various drawing figures.

IN THE DRAWING

DETAILED DESCRIPTION OF THE PREFERRED EMBODIMENT

Figure 1:
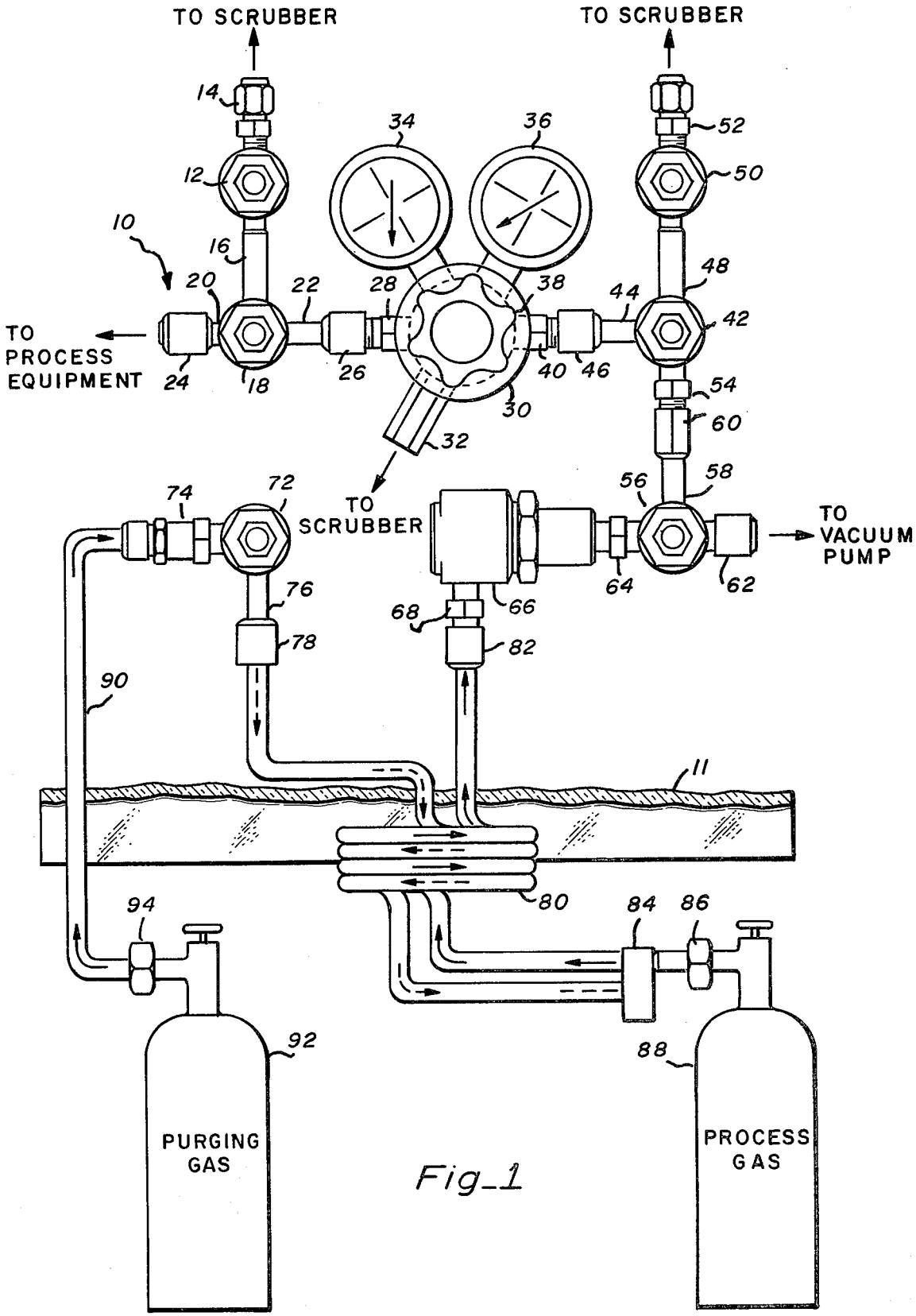
FIG. 1 is a front elevational view of a purging apparatus of the present invention and illustrating its connection to a purging gas cylinder and process gas cylinder.

In FIG. 1, there is illustrated a purging apparatus referred to by the general reference character 10 and incorporating the present invention. The purging apparatus 10 is adapted such that it may be hard mounted to a stationary panel or wall 11. The apparatus 10 includes a low pressure vent valve 12 connected to a male connector 14 and also to an adapter 16. The low pressure vent valve 12 has two settings: one permitting flow from the adapter 16 to the male connector 14 and the other blocking any flow through the valve 12. The adapter 16 is connected to a low pressure process valve 18. Connected to the low pressure process valve 18 are connectors 20 and 22. The connectors 20 and 22 include nuts 24 and 26, respectively. The low pressure process valve 18 has two settings: one permitting flow from the connector 22 to the connector 20 and the other permitting flow from the connector 22 to the adapter 16. The nut 26 receives a male connector 28 which is connected to a regulator 30. The regulator 30 includes a relief valve 32, a low pressure gauge 34, a high pressure gauge 36, and a handle 38. Also connected to the regulator 30 is a male connector 40. The regulator 30 adjusts the pressure on the process equipment side (also referred to as the low pressure side) of the regulator to a specified level in order to provide the process with gases at the required pressures.

The purging apparatus 10 includes a high pressure process valve 42. Connected to the high pressure process valve 42 is a connector 44 which includes a nut 46 adapted to receive the male connector 40. Also connected to the high pressure process valve 42 is an adapter 48 which is connected to high pressure vent valve 50, which is in turn connected to a male connector 52. A male connector 54 is connected to the high pressure process valve 42. The high pressure process valve 42 has two settings: a first setting to permit gas to flow from the male connector 54 to the connector 44, and a second setting to permit gas to flow from the male connector 54 to the adapter 48. The high pressure vent valve 50 has open and closed settings such that in the open setting gas may flow from the adapter 48 to the male connector 52 and to the vent or scrubber, and in the closed setting no gas will flow through the vent valve 50.

The purging apparatus 10 includes a vacuum pump valve 56. Connected to the vacuum pump valve 56 is a connector 58 which includes a nut 60 adapted to receive the male connector 54. Also connected to the vacuum pump valve 56 are a connector 62 and an adapter 64. The vacuum pump valve 56 has two settings: i.e. a first setting permits gas to flow from the adapter 64 to the connector 58 and a second setting to permit gas to flow from both the adapter 64 and the connector 58 to the connector 62 and to the vacuum pump. The adapter 64 is connected to a filter 66. Connected to the filter 66 is a male connector 68. The purging apparatus 10 also includes a purge valve 72 which is also mounted to the panel 11. Connected to the purge valve 72 are a check valve 74 and a connector 76 which includes a nut 78. The purge valve 72 has open and closed settings: i.e. in the open setting gas may flow from the check valve 74 to the connector 76 and in the closed setting gas flow through the purge valve 72 is blocked.

A double helix of tubing 80 is connected to the nut 78 and to the male connector 68 by means of a nut 82. The double helix 80 is also connected to a process gas connector 84 which includes a nut 86. The process gas connector 84 is connected to a process gas cylinder 88 by means of the nut 86. As illustrated the helix of tubing 80 comprises a multiplicity of full loops such that it provides vertical flexibility whereby cylinders 88 of various heights and orientations may be accommodated.

The check valve 74 is connected to a tube 90 which is connected to a purging gas cylinder 92 by means of a nut 94.

Figure 2:
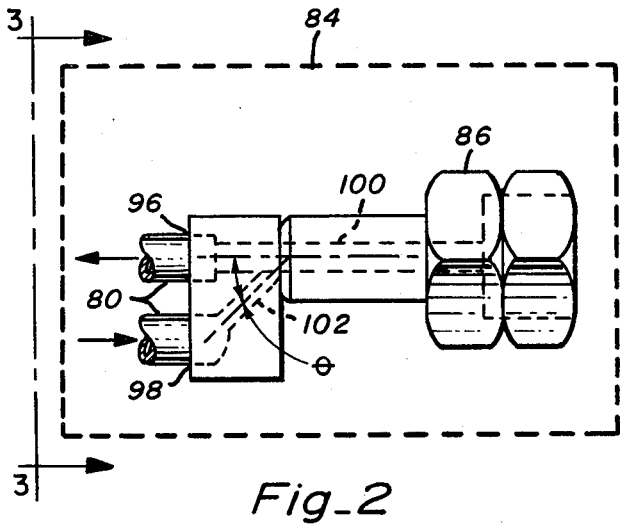
FIG. 2 is a side-elevational view of the process gas connector of FIG. 1.
Figure 3:
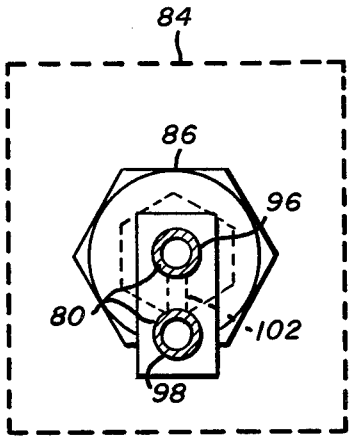
FIG. 3 is a front elevational view of the process gas connector of FIG. 1.

FIGS. 2 and 3 illustrate in greater detail the process gas connector 84 with FIG. 2 being a side view and FIG. 3 an end view. The process gas connector 84 includes a process gas exit port 96 and an injection port 98 for the purging gas. A channel 100, extending to the port 96, passes through the process gas connector 84. A channel 102 connects the injection port 98 to the channel 100 with the center line of the channel 102 intersecting the center line of the channel 100 at an acute angle $\theta$. Preferrably the angle $\theta$ is within the range of 15°–45°. In connecting the helix tubing 80 to the connector 84 in the preferred embodiment the helix tubes are welded to the process gas connector 84 at the process gas port 96 and the injection port 98. However, the helix tubing 80 may also be mechanically connected to the process gas connector 84.

The operation of the purging apparatus 10 is believed to be as follows. The male connector 52 and the male connector 14 are connected to a vent or scrubber for venting process gas during the purging procedure. The relief valve 32 is also connected to a vent or scrubber to vent process gas in the event the gas pressure on the low pressure side of the regulator 30 rises above acceptable limits. The double tubing helix 80 has two flow paths: i.e. the first path connects the purge valve 72 to the injection port 98 of the process gas connector 84 (as illustrated by the broken-line arrows) and the second flow path connects the filter 66 to the process gas port 96 of the process gas connector 84 as illustrated by the solid-line arrows.

During normal operation, when the process gas from the process gas tank 88 is fed to the process equipment it flows through the double helix 80 to the filter 66, through the vacuum pump valve 56 to the high pressure process valve 42, through the regulator 30, to the low pressure process valve 18 and out through the connector 20 which is connected to the process equipment connected through the nut 24. The pressure of the process gas on the process equipment side of the regulator 30 is adjusted by means of the handle 38. Alternatively, the regulator may also be controlled by an air or inert gas pressure instead of a handle. During the time the process gas is fed to the process equipment the purge valve 72 is closed.

When the process gas cylinder 88 is empty, the process gas must be purged from the purging apparatus 10 before the process gas cylinder 88 is disconnected. The first step is to perform a straight through flow purge. Initially, the purge valve 72, the high pressure vent valve 50 and the low pressure vent valve 12 are closed and the flow path to the process equipment is open. The valve to the process gas cylinder 88 is then closed. The high pressure process valve 42 is next set to permit flow from the male connector 54 to the adapter 48. The next step is to set the low pressure process valve 18 to permit flow from the connector 22 to the adapter 16. This is merely a precautionary step to protect the process equipment.

The valve to the purging gas cylinder 92 is opened and the cylinder pressure checked to be sure that at least sixty PSI is available. It should be noted that the purging gas cylinder 92 is normally equipped with a regulator to reduce the pressure to approximately 100 PSI. The purge valve 72 is now opened for approximately ten seconds to allow the purging gas to mix with and dilute the process gas. The check valve 74 prevents the process gas from contaminating the purging gas in the purging gas cylinder 92. After waiting approximately ten seconds, without closing the purge valve 72, the high pressure vent valve 50 is open. The purging gas will then flow through the associated line of the double helix tubing 80 to the process gas connector 84, then back through the other line of the double helix tubing 80, up to the high pressure vent valve 50 and out to the scrubber. The purging gas is allowed to flow for between approximately fifteen and approximately forty-five seconds at which time the high pressure vent valve 50 is closed. The purge valve 72 is then closed and the straight through flow purging procedure is completed.

Referring to FIG. 2, it can be seen that the purging gas enters through the injection port 98, then flows through the channel 102 and into the channel 100. Since the channel 102 intersects the channel 100 at an angle, there will be a turbulence created in the gas flow causing a very effective mixing of the purging gas with the process gas right up to the process gas cylinder 88.

After the straight through purge cycle procedure is completed, a cycle/dilute purge procedure is begun. The purge valve 72 is opened briefly then closed. Next, the high pressure vent valve 50 is opened briefly then closed. It is recommended that purge valve 72 and vent valve 50 be held open for at least ten seconds. This process is repeated approximately fifteen times. This procedure further dilutes and vents remaining process gas trapped in the purging apparatus 10. Before disconnecting the process gas cylinder 88, the purge valve 72 is opened slightly so there is a slight flow of the purging gas. However, this procedure should only be followed where the purging gas cylinder 92 includes a regulator to reduce the pressure to approximately 100 PSI. The nut 86 is then loosened and the process gas cylinder removed. A new process gas cylinder is then connected to the purging apparatus 10. After the nut 86 is tightened down on the new tank, a leak check should be made.

If the process being performed is not affected by the purging gas, then the cycle/dilute purge procedure is repeated. This removes any air from the purging apparatus 10 which entered the system while the process gas cylinder 88 was being changed. However, if the process being performed reacts adversely to the purging gas, then a vacuum procedure must be performed. To begin the vacuum procedure the purge valve 72 is closed, the high pressure process valve 42 is set to permit flow from the adapter 48 to the male connector 54 and the high pressure vent valve 50 is closed. A vacuum pump is connected to the connector 62 and the vacuum pump valve 56 is set to permit flow from the adapter 64 and the connector 68 to the connector 62. The vacuum pump is then turned on and the purging gas is removed from the purging apparatus 10.

After the purging gas has been removed from the purging apparatus 10, the vacuum pump valve 56 is set to permit flow from the adapter 64 to the connector 58 and the vacuum pump is shut off.

To begin supplying process gas to the process equipment the process gas cylinder 88 is opened. Next, the high pressure process valve 42 is set to permit flow from the male connector 54 to the connector 44 and then the low pressure process valve 18 is set to permit flow from the connector 22 to the connector 20.

As illustrated the apparatus 10 is normally mounted to a panel. The panel 11 may be printed with identification of each component and show positions of the valve handles e.g. "on," "off," etc. It will readily accommodate process gas tanks of various sizes and shapes since the helix tubing 80 is flexible in all directions. Thus, height adjustments may be made at the helix tubing 80 without any effect on any of the apparatus.

The preferred embodiment has been described to include the vacuum pump valve 56 and the connector 62. If a process does not require the vacuum purge procedure, the vacuum pump valve 56 and connector 62 may be substituted with an elbow. Also, in some systems, the filter 66 will not be necessary and may be substituted with an element having a straight through flow path.

The low pressure vent valve 12 and the low pressure process valve 18 allow purging of the low pressure side of the purging apparatus 10. Purging of the low pressure side of the purging apparatus 10 is necessary where the regulator 30 is to be disconnected for servicing. These valves may also be excluded in a stripped-down system.

Although the present invention has been described in terms of the presently preferred embodiment, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

We claim:

1. A purging apparatus comprising:

first source means for receiving a purging gas source;

first valve source means connected to the first means for receiving said purging gas source for controlling the flow of said purging gas;

a first flexible tube connected to the first valve means;

a process gas connector including connecting means for connecting to a process gas supply, a process gas port, a process gas channel between said process gas port and said connecting means for connecting to said process gas supply, an injection port, and an injection channel between said injection port and said process gas channel, said injection port being connected to the first flexible tube and intersecting said process gas channel at an acute angle and in close proximity to the process gas source;

a second flexible tube connected about one end to said process gas port of the process gas connector;

second valve means being connected to the second flexible tube and conduit means for receiving the process gas flow, the second valve means having a vent port and a process port for directing gas flow from the second flexible tube to said vent port or to said process port;

third valve means connected to said vent port of the second valve means for controlling the release of gas from the purging apparatus;

a regulator having a high pressure port and a low pressure port, said high pressure port of the regulator connected to said process port of the second valve means;

means for connecting process equipment to said low pressure port of the regulator and said purging gas purges the first and second flexible tubes, the process gas connector, the first, second, and third valve means, the conduit means and exits the vent ports of the second and third valve means.

2. A purging apparatus comprising:

first source means for receiving a purging gas source;

first valve means connected to the first source means for receiving said purging gas source for controlling the flow of said purging gas;

a first flexible tube connected to the first valve means;

a process gas connector including connecting means for connecting to a process gas supply, a process gas port, a process gas channel between said process gas port and said connecting means for connecting to said process gas supply, an injection port, and an injection channel between said injection port and said process gas channel, said injection port being connected to the first flexible tube and intersecting said process gas channel at an acute angle and in close proximity to the process gas source;

a second flexible tube connected about one end to said process gas port of the process gas connector;

second valve means being connected to the second flexible tube, the second valve means having a vent port and a process port for directing gas flow from the second flexible tube to said vent port or to said process port;

third valve means connected to said vent port of the second valve means for controlling the release of gas from the purging apparatus;

a regulator having a high pressure port and a low pressure port, said high pressure port of the regulator connected to said process port of the second valve means;

means for connecting process equipment to said low pressure port of the regulator;

fourth valve means connected to the low pressure port of the regulator and having the means for connecting to process equipment connected to a process port of the fourth valve means and also including a vent port for directing gas flow from said low pressure port of the regulator to said process port of the fourth valve means or to said vent port of the fourth valve means; and fifth valve means connected to the vent port of the fourth valve means and including a vent port for controlling release of gas from the purging apparatus through said vent port of the fifth valve means.

3. The purging apparatus of claim 2, further comprising sixth valve means connected between the second flexible tube and the second valve means and including a vacuum pump port for permitting gas flow from the second flexible tube to the second valve means or for permitting gas flow from the second flexible tube and second valve means to said vacuum pump port.

4. The purging apparatus of claim 1 or 2 further comprising a filter connected between the second flexible tube and the second valve means.

5. The purging apparatus of claim 3, further comprising a filter connected between the second flexible tube and the sixth valve means.

6. The purging apparatus of claim 1 or 2, wherein the first flexible tube and second flexible tube form a double helix of tubing.

7. The purging apparatus of claim 1 or 2, wherein said acute angle is between 15° and 45°.

8. The purging apparatus of claim 6 wherein the double helix of tubing comprises a multiplicity of loops of each the first and the second tube; and including rigid support means intermediate the filter and the first valve means.

9. The purging apparatus of claim 1 or 2 further comprising a check valve connected between the purging gas source and the first valve means, said check valve permitting flow of gas away from, but not toward, the purging gas source.

* * * * *